United States Patent [19]

Rasmussen

[11] Patent Number: 5,016,325

[45] Date of Patent: May 21, 1991

[54] STRAP CONNECTOR

[76] Inventor: Donald D. Rasmussen, P.O. Box 250, Tualatin, Oreg. 97062

[21] Appl. No.: 524,567

[22] Filed: May 17, 1990

[51] Int. Cl.[5] ..... A44B 21/00

[52] U.S. Cl. ..... 24/68 R; 24/68 CD; 24/71.2

[58] Field of Search ..... 24/68 CD, 68 R, 68 CT, 24/68 T, 69 R, 71.2; 294/74

[56] References Cited

U.S. PATENT DOCUMENTS

| | | | |
|---|---|---|---|
| 3,120,946 | 2/1964 | McCormack et al. | 24/68 CT |
| 3,754,733 | 8/1973 | Foster | 24/68 R |
| 4,315,350 | 2/1982 | Looker et al. | 24/68 CD |
| 4,507,829 | 4/1985 | Looker | 24/68 CT |
| 4,525,007 | 6/1985 | Chapalain | 294/74 |
| 4,823,443 | 4/1989 | Waters | 24/68 CD |

*Primary Examiner*—Victor N. Sakran
*Attorney, Agent, or Firm*—Eugene M. Eckelman

[57] ABSTRACT

A U-shaped body portion has an attaching end for a cable or hitch connection and an opposite open end for receiving a strap to be connected to the body portion. The body portion includes a pair of anchor bars arranged to receive a doubled back and looped end of a strap arranged to pinch the strap when a pulling tension is applied to the strap. A removable pin is mounted in the body portion and disposed between the anchor bars and the attaching end for insertion in the loop of the looped end of the strap.

5 Claims, 2 Drawing Sheets

STRAP CONNECTOR

BACKGROUND OF THE INVENTION

This invention relates to new and useful improvements in strap connectors.

In my U.S. Pat. No. 4,799,296 a strap connector is illustrated which comprises a body portion having a hollow interior and including stationary anchor means in the body portion arranged to receive a strap capable of releasable securement thereto. The anchor means in this patented structure is arranged to provide attachment for the strap wherein the free end portion of the strap is pinched under a load connected end portion thereof by a tension force. A releasable pin is provided in the body portion and is arranged for insertion in the loop of a double back portion of the strap for positioning the loop in its pinched secured position on the body portion and for release from the body portion when it is desired to disconnect the strap from the connector. This prior structure includes a ratchet assembly arranged to take up an excess of the free end of the strap.

Such a connector structure has important advantages, one advantage being that the free end of the strap can be unobstructed and thus can be readily pulled free of components that were moved with the strap. Another advantage is that specific strap lengths do not have to be supplied since one length of strap may be utilized and specific lengths thereof accommodated by releasable securement at any point on the strap.

SUMMARY OF THE INVENTION

According to the present invention and forming a primary objective thereof, a strap connector is provided that has structural and functional advantages over prior strap connectors.

Specific objects of the invention are to provide a strap connector of the type described that provides securement for either of two strap portions that lead from a doubled back looped end associated with a releasable pin in the connector, thus making the connector more versatile and simpler to use than prior structures. Another object is to provide a connector wherein the overall structure thereof is simplified and inexpensive to manufacture.

In carrying out the objectives of the invention, the body portion of the connector has opposite ends with one of the ends comprising an attaching end for powered strap tension means and the other end being open for receiving a strap to be attached to the connector. The connector has stationary anchor means mounted in the body portion which are arranged to receive a doubled back and looped end of a strap comprising a strap excess end portion and a load connected end portion. The anchor means are arranged to pinch the strap excess end portion and the load connected end portion thereagainst as a result of a pulling tension on the load connected end portion. Removable pin means are provided in the body portion which are disposed in the strap receiving area between the anchor means and the attaching end of the body portion for insertion in the loop of the looped end of the strap. Each end of the looped strap extends freely through the open end of the body portion and thus either of such ends may be employed as the load connected end portion.

The invention will be better understood and additional objects and advantages will become apparent from the following description taken in connection with the accompanying drawings.

DETAILED DESCRIPTION OF PREFERRED EMBODIMENTS

Figure 1:
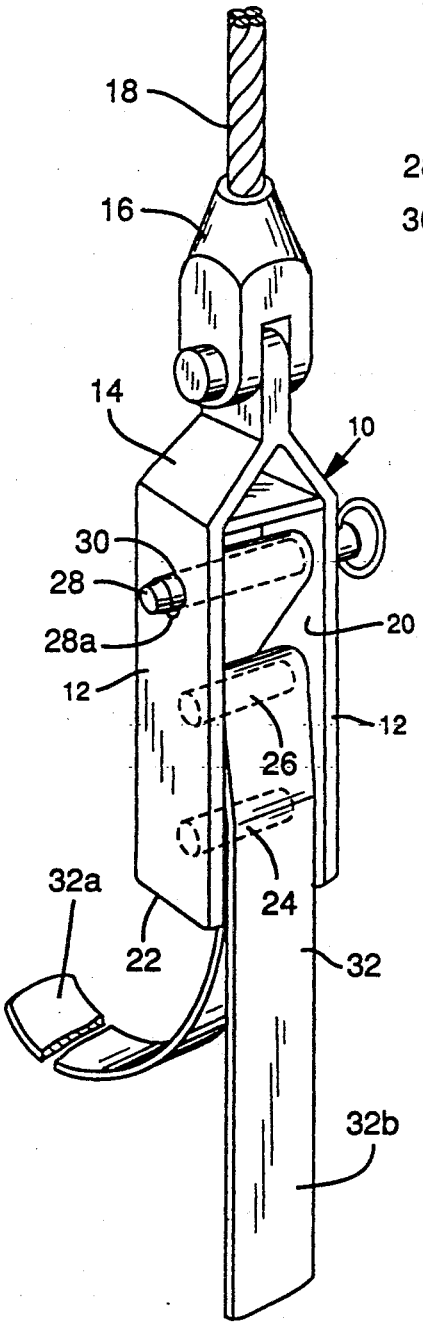
FIG. 1 is a perspective view of a first embodiment of strap connector of the invention showing a strap secured thereto.
Figure 2:
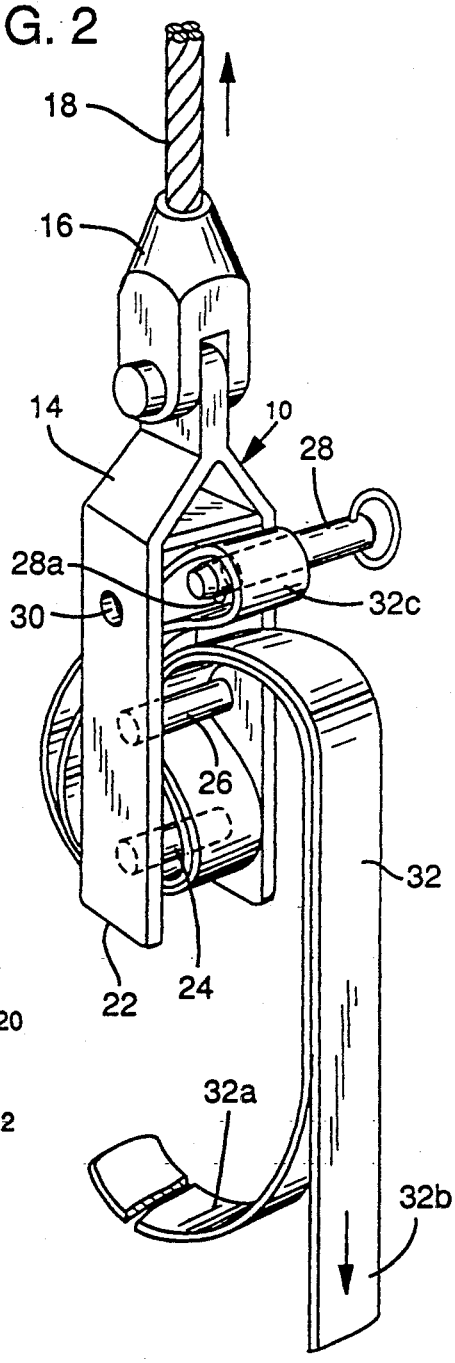
FIG. 2 is a perspective view similar to FIG. 1 but showing the connector in a process of being loaded.
Figure 3:
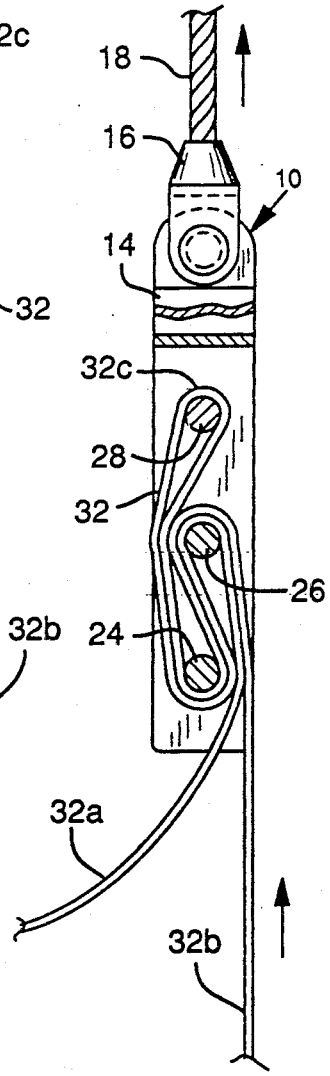
FIG. 3 is a side elevational view of the connector, a side wall thereof being broken away to illustrate in detail the strap securement thereto.

With particular reference first to FIGS. 1–3, the present connector comprises a U-shaped body portion 10 with parallel side walls 12 and a reinforced end portion 14 arranged for attachment to a shackle 16 of a cable 18. The other two sides of the body portion are open to provide access from either side to a strap receiving area 20 between the walls 12. The bottom 22 of the body portion is also open.

A pair of heavy duty cross bars 24 and 26 extend integrally between the walls 12 with the first cross bar 24 located adjacent the open end 22 of the body portion and with the cross bar 26 spaced therefrom in a direction toward the closed end of the body portion. Located between the closed end of the body portion and cross bar 26 is a pin 28 removably mounted in opposite apertures 30. Pin 28 includes spring pressed catch means **28*a*** which provide a positive but releasable securement of the pin in the body portion.

Numeral 32 represents a strap of the type to which the present connector is intended to be used. For purposes of explanation, the numeral **32*a* designates a free or excess end of the strap and the numeral 32*b* designates a load engaging portion. In the use of the connector, the slack in the strap between the body portion of the connector and the load is taken out and then the strap connected to the body portion. For establishing a connection the free end 32*a*, after the slack has been removed, is doubled back on the load connected end 32*b* to form an end loop 32*c*. This doubled back portion is made of a sufficient length such that it can be reeved around the cross bars 24 and 26 and hooked on the pin 28 in the manner shown specifically in FIG. 3**.

More particularly, a sufficient length of doubled back strap at the free end is first brought in at one open side of the body portion, for example, the right side in FIG. 3, and reeved over the cross bar 26. From there, this doubled portion is reeved down and up around cross bar 24 in a manner such that it extends up along the opposite open side of the body portion. Pin 28 is removed during this loading process, and to complete the loading of the strap in the body portion, the looped end **32*c* of the strap is brought up in alignment with the apertures 30 and the pin 28 installed through the apertures 30 and through the loop 32*c*. The unused end 32*a*** of the strap merely hangs free. Since the connector can be combined with the strap at any point on the strap, one length of strap can serve many length requirements for different loads. The strap or straps can have length indicia thereon for selected engagement with the strap connector whereby to readily determine points of connection for single straps or for coordination between lifts utilizing more than one strap.

With both of the ends 32*a* and 32*b* extending freely through the bottom open end of the body portion 14, it is apparent that the doubled back strap can be loaded from either of the open sides of the body portion and reversed from that shown in FIG. 3 if desired. Also, either of the ends 32*a* or 32*b* can be the load connected end and the other of these ends can be the free end. Where the strap end 32*b* comprises the load connected end, as shown in FIG. 3, the pinched engagement of the free end is on the upper side of cross bar 26, whereas if the end 32*a* is the load connected end, pinched engagement will occur on the underside of the cross bar 24. Thus the device is readily loaded and cannot accidentally be misloaded.

For disconnecting the strap from the device, it is merely necessary to provide slack in the load connected end and remove the pin 28.

Figure 4:
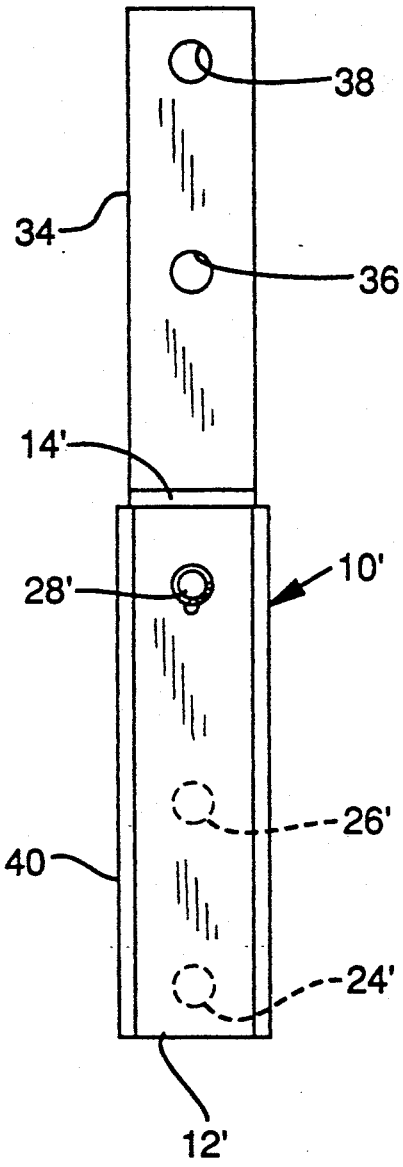
FIG. 4 is a side elevational view of a second embodiment of the invention wherein the connector can be used in combination with a box hitch.
Figure 5:
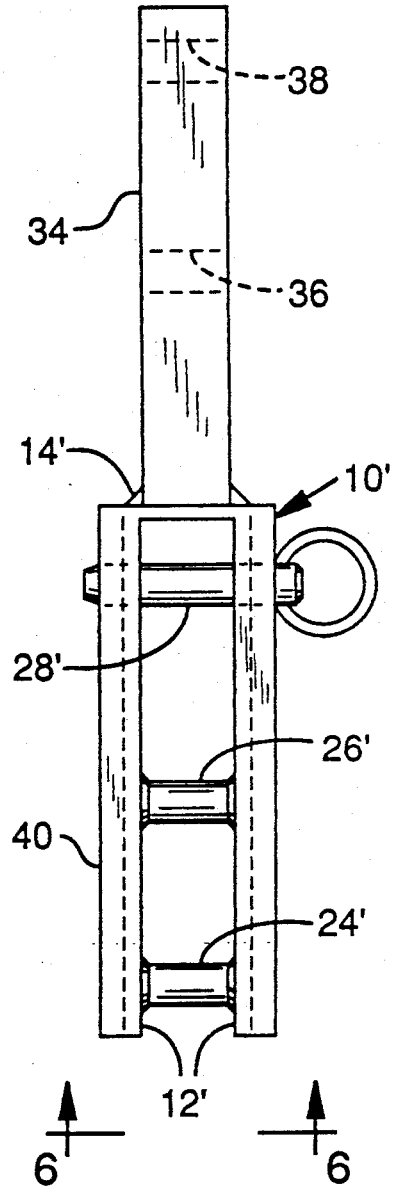
FIG. 5 is a top plan view of the second embodiment.
Figure 6:
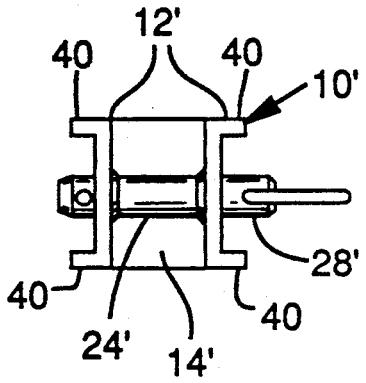
FIG. 6 is a front elevational view.

The embodiment of FIGS. 4, 5 and 6 illustrate use of the invention as a tow bar. In such embodiment, the body portion 10' has opposite side walls 12' similar to the embodiment of FIG. 1 and also employs similar integral cross bars 24' and 26' as well as removable pin 28'. Connection of the strap with this portion of the body portion is identical to that of the FIG. 1 embodiment. The closed end 14' of the second embodiment is associated with an integral extension 34 arranged for releasable securement in a conventional box-type hitch portion, not shown. Extension 34 has an aperture 36 that receive the usual hitch pin in the box type hitches. Extension 34 is also provided with an aperture 38 adjacent the end thereof capable of connection to a shackle instead of a trailer hitch box. The embodiment of FIGS. 4–6 thus can be used as a connector in combination with a box type hitch wherein the pulling connection comprises a strap, or, by using aperture 38, it can be used as a lifting connector as in FIGS. 1–3. As best seen in FIG. 6, the body portion 10 has angle extensions 40 for reinforcing this portion of the connector in its use as a hitching device.

It is to be understood that the forms of my invention herein shown and described are to be taken as preferred examples of the same and that various other changes in the shape, size and arrangement of parts may be resorted to without departing from the spirit of my invention, or the scope of the subjoined claims.

Having thus described my invention, I claim:

1. A strap connector for use with a strap having a pair of free ends, said connector comprising:

a body portion having a strap receiving area therein, said body portion having opposite ends, one of said ends comprising an attaching end for powered tension means and the other of said ends being open into the strap receiving area, a pair of anchor bars mounted in said body portion and receiving a doubled back and looped end of the strap thereover with the free ends of the strap comprising a strap excess end portion and a load connected end portion, said anchor bars being positioned such that one of them pinches the strap excess end portion between said one bar and the load connected end portion by a pulling tension on the latter and with the strap excess portion extending freely from said anchor bars and from said body portion to allow either of said free ends of the strap to be the strap excess portion or the load connected end portion, and pin means mounted removably in said body portion, said pin means being disposed in said strap receiving area between said pair of anchor bars and said attaching end arranged for insertion in the loop of the looped end of the strap for holding the latter in a secured position on said body portion with the free end of the strap inched between said one anchor bar and the load connected end portion and also arranged for removal from the strap receiving area to release the strap from said body portion.

2. The strap connector of claim 1 wherein said attaching end comprises a hitch portion for vehicle towing.

3. The strap connector of claim 2 wherein said hitch portion comprises an extension arranged for connection to a box hitch portion.

4. The strap connector of claim 1 wherein said attaching end comprises a hitch portion for vehicle towing, said attaching end also including means arranged for connection to a cable whereby to provide alternative use.

5. A strap connector for use with a strap having a pair of free ends, said connector comprising:

a body portion having a strap receiving area therein, said body portion having opposite ends, one of said ends comprising an attaching end for powered tension means and the other of said ends being open into the strap receiving area, a pair of anchor bars mounted in said body portion receiving a doubled back and looped end of the strap thereover with the free ends of the strap comprising a strap excess end portion and a load connected end portion, said anchor bars being positioned such that one of them pinches the strap excess end portion between it and the load connected end portion by a pulling tension on the latter and with the strap excess portion extending freely from said anchor bars and from said body portion, to allow either of said free ends of the strap to be the strap excess portion or the load connected end portion, and pin means mounted removably in said body portion, said pin means being receivable in the loop of the looped end of the strap for holding the latter in a secured position on said body portion with the free end of the strap inched between said one anchor bar and the load connected end portion and also arranged for removal from the strap receiving area to release said strap from said body portion.

* * * * *